US007128299B1

(12) United States Patent
Klotz

(10) Patent No.: US 7,128,299 B1
(45) Date of Patent: Oct. 31, 2006

(54) BEVERAGE CONTAINER/COASTER SYSTEM

(76) Inventor: Donald K. Klotz, 10672 Hamlin Blvd., Largo, FL (US) 33774

( * ) Notice: Subject to any disclaimer, the term of this patent is extended or adjusted under 35 U.S.C. 154(b) by 70 days.

(21) Appl. No.: 10/840,315

(22) Filed: May 6, 2004

(51) Int. Cl.
*A47B 91/00* (2006.01)

(52) U.S. Cl. ..... 248/346.11

(58) Field of Classification Search ..... 248/346.11, 248/311.2, 154, 146; D7/625, 624.1; D21/548, D21/549, 765; 446/93, 279, 466
See application file for complete search history.

(56) References Cited

U.S. PATENT DOCUMENTS 1,585,649 A * 5/1926 Carley et al. ..... 446/78
3,777,392 A * 12/1973 Span et al. ..... 446/78
3,883,983 A * 5/1975 Coster ..... 446/78
4,372,453 A * 2/1983 Branscum ..... 215/12.2
5,186,350 A * 2/1993 McBride ..... 220/739
D467,123 S * 12/2002 Dutour et al. ..... D7/515
6,488,556 B1 * 12/2002 Galomb ..... 446/73
6,857,930 B1 * 2/2005 Lawley, Jr. ..... 446/456
6,877,705 B1 * 4/2005 Dauer ..... 248/346.11
2002/0145010 A1 * 10/2002 Ufheil et al. ..... 222/153.14

* cited by examiner

*Primary Examiner*—A. Joseph Wujciak, III
(74) *Attorney, Agent, or Firm*—Edward P. Dutkiewicz

(57) ABSTRACT

A platform has wheels extending below the platform and a generally flat upper surface. A coupling means has a top and a bottom. The bottom is coupled to the platform. A beverage container has a lower region. The lower region is configured for allowing the beverage container to be coupled to top of the intermediate member and to be removed therefrom for the consumption of a beverage therein.

2 Claims, 4 Drawing Sheets

BEVERAGE CONTAINER/COASTER SYSTEM

BACKGROUND OF THE INVENTION

1. Field of the Invention

The present invention relates to a beverage container/coaster system and more particularly pertains to retaining a beverage spaced above a recipient surface.

2. Description of the Prior Art

The use of beverage retainers of known designs and configurations is known in the prior art. More specifically, beverage retainers of known designs and configurations previously devised and utilized for the purpose of retaining beverages through known methods and configurations are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 1,918,866 issued Jul. 18, 1933 to Reget relates to a decorative table device. U.S. Pat. No. 3,086,314 issued Apr. 23, 1963 to Pender relates to a coaster. Lastly, U.S. Pat. No. 3,410,514 issued Nov. 12, 1968 to Ford relates to a placement with detachable coasters.

While these devices fulfill their respective, particular objectives and requirements, the aforementioned patents do not describe beverage container/coaster system that allows retaining a beverage spaced above a recipient surface.

In this respect, the beverage container/coaster system according to the present invention substantially departs from the conventional concepts and designs of the prior art, and in doing so provides an apparatus primarily developed for the purpose of retaining a beverage spaced above a recipient surface.

Therefore, it can be appreciated that there exists a continuing need for a new and improved beverage container/coaster system which can be used for retaining a beverage spaced above a recipient surface. In this regard, the present invention substantially fulfills this need.

SUMMARY OF THE INVENTION

In view of the foregoing disadvantages inherent in the known types of beverage retainers of known designs and configurations now present in the prior art, the present invention provides an improved beverage container/coaster system. As such, the general purpose of the present invention, which will be described subsequently in greater detail, is to provide a new and improved beverage container/coaster system and method which has all the advantages of the prior art and none of the disadvantages.

To attain this, the present invention essentially comprises a toy vehicle. The toy vehicle has a horizontally disposed base frame. The base frame has four wheels. The wheels are rotatably coupled to the base frame. The wheels extend below the base frame. The toy vehicle also has a body. The body extends above the base frame. The body has a generally flat upper surface. The flat upper surface is in an essentially horizontal plane.

An intermediate member is provided. The intermediate member has a hollow cylindrical side wall. The side wall has a diameter, a top and a bottom. A vertical axis is provided between the top and the bottom. The top is formed as an open circular top. The bottom is formed as a closed circular bottom. An upper face is provided. The upper face is coupled to the side wall at its lower extent. A lower face is provided.

The lower face is secured to the flat upper surface of the body of the toy vehicle. The intermediate member includes thermal insulation in the side wall and in the bottom.

Provided last is a beverage container. The beverage container includes a cylindrical lower region. The lower region has a diameter less than the diameter of the intermediate member. In this manner the beverage container may be inserted into the intermediate member and removed from the beverage container for the consumption of a beverage. The cylindrical lower region of the beverage container is adapted to be supported by the upper face of the bottom of the intermediate member. The lower region is supported at a location above the table top. In this manner staining of the table top or other recipient surface is precluded. The beverage container is adapted to be removed from the intermediate member for the consumption of a beverage within the container. The toy vehicle is adapted to be easily moved by rolling around a table top or other recipient surface whether or not the beverage container is in or out of the intermediate member.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved beverage container/coaster system which has all of the advantages of the prior art beverage retainers of known designs and configurations and none of the disadvantages.

It is another object of the present invention to provide a new and improved beverage container/coaster system which may be easily and efficiently manufactured and marketed.

It is further object of the present invention to provide a new and improved beverage container/coaster system which is of durable and reliable constructions.

An even further object of the present invention is to provide a new and improved beverage container/coaster system which is susceptible of a low cost of manufacture with regard to both materials and labor, and which accordingly is then susceptible of low prices of sale to the consuming public, thereby making such beverage container/coaster system economically available to the buying public.

Even still another object of the present invention is to provide a beverage container/coaster system for retaining a beverage spaced above a recipient surface.

Lastly, it is an object of the present invention to provide a new and improved beverage container/coaster system. A platform has wheels extending below the platform and a generally flat upper surface. A coupling means has a top and a bottom. The bottom is coupled to the platform. A beverage container has a lower region. The lower region is configured for allowing the beverage container to be coupled to top of the intermediate member and to be removed therefrom for the consumption of a beverage therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
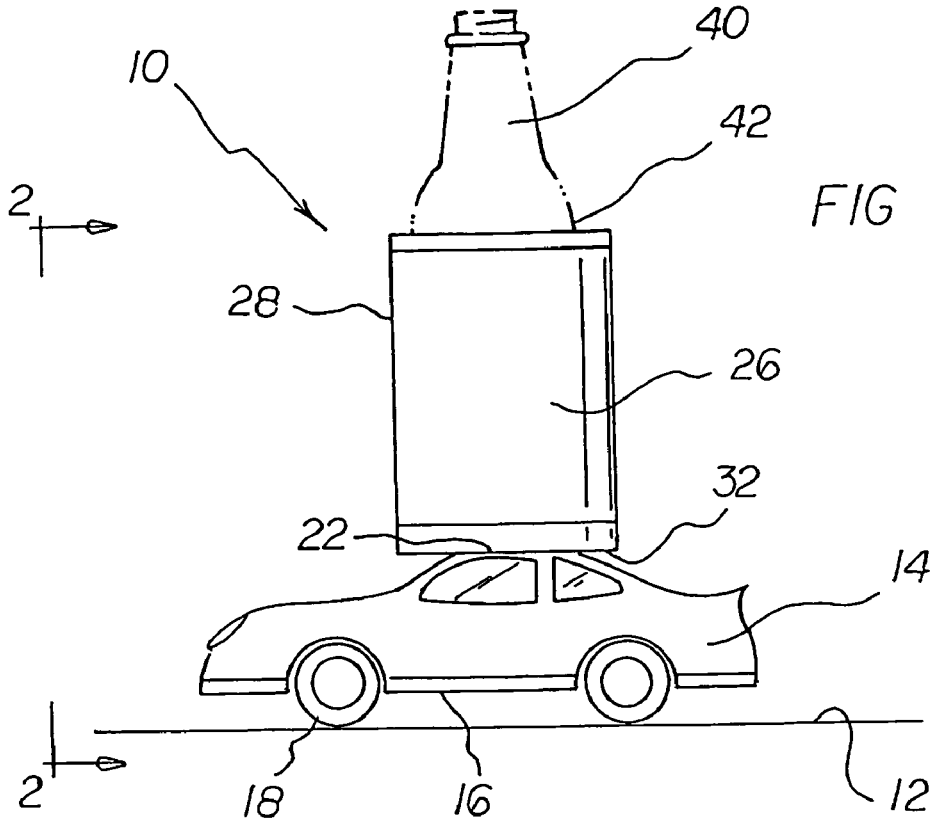
FIG. 1 is a side elevational view of a beverage container/coaster system constructed in accordance with the principles of the present invention.
Figure 2:
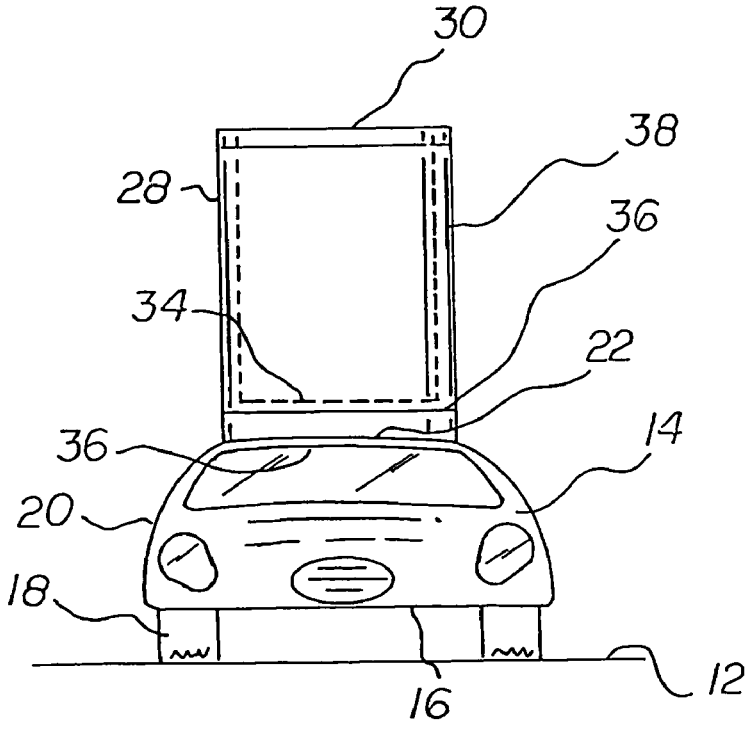
FIG. 2 is a front elevational view taken at line 2—2 of FIG. 1.

With reference now to the drawings, and in particular to FIG. 1 thereof, the preferred embodiment of the new and improved beverage container/coaster system embodying the principles and concepts of the present invention and generally designated by the reference numeral 10 will be described.

The present invention, the beverage container/coaster system 10 is comprised of a plurality of components. Such components in their broadest context include a toy vehicle, an intermediate member, and a beverage container. Such components are individually configured and correlated with respect to each other so as to attain the desired objective.

First provided is a toy vehicle 14 also formed as a platform. The toy vehicle has a horizontally disposed base frame 16. The base frame has four wheels 18. The wheels are rotatably coupled to the base frame. The wheels extend below the base frame. The toy vehicle also has a body 20. The body extends above the base frame. The body has a generally flat upper surface 22. The flat upper surface is in an essentially horizontal plane. In an alternate embodiment, the coaster or platform may be of any configuration such as, but not limited to, a car, boat, airplane and skateboard.

An intermediate member 26 is provided. The intermediate member has a hollow cylindrical side wall 28. The side wall has a diameter, a top 30 and a bottom 32. A vertical axis is provided between the top and the bottom. The top is formed as an open circular top. The bottom is formed as a closed circular bottom. An upper face 34 is provided. The upper face is coupled to the side wall at its lower extent. A lower face 36 is provided. The lower face is secured to the flat upper surface of the body of the toy vehicle. The intermediate member includes thermal insulation 38 in the side wall and in the bottom.

The intermediate member may be a coupling means such as an adhesive, a magnet, a female and male thread, a Luer lock, a latch, a hook and loop fastener, or the like.

Provided last is a beverage container 40. The beverage container includes a cylindrical lower region 42. The lower region has a diameter less than the diameter of the intermediate member. In this manner the beverage container may be inserted into the intermediate member and removed from the beverage container for the consumption of a beverage. The cylindrical lower region of the beverage container is adapted to be supported by the upper face of the bottom of the intermediate member. The lower region is supported at a location above the table top. In this manner staining of the table top or other recipient surface is precluded. The beverage container is adapted to be removed from the intermediate member for the consumption of a beverage within the container. The toy vehicle is adapted to be easily moved by rolling around a table top or other recipient surface whether or not the beverage container is in or out of the intermediate member. In an alternate embodiment, the wheels may be fixed or rotatable.

Figure 3:
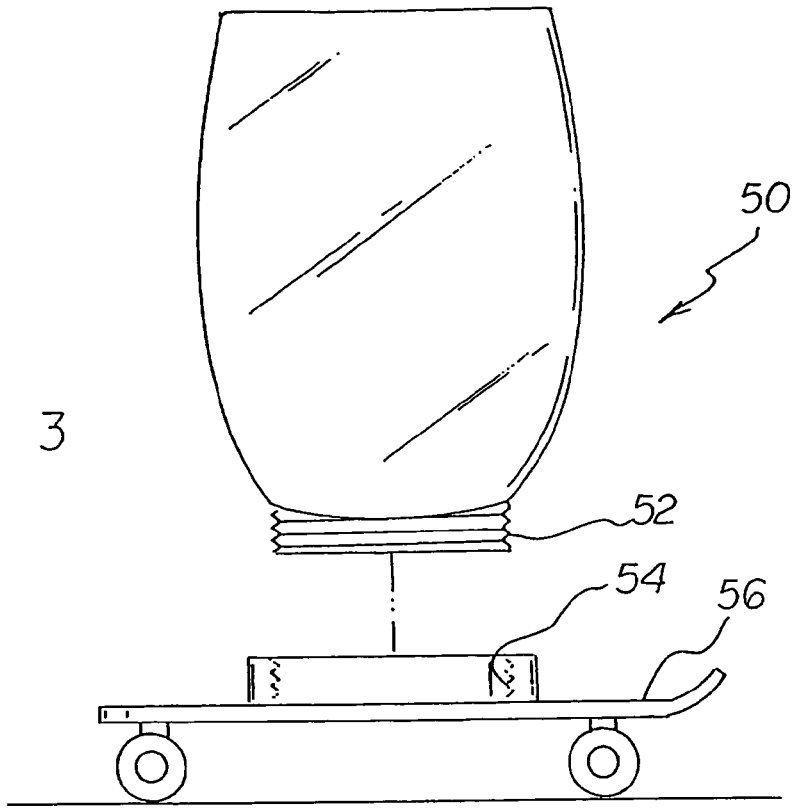
FIG. 3 is a side elevational view of an alternate embodiment of the invention.

In an alternate embodiment of the present invention the system 50 includes male threads 52. The male threads extend downwardly from the beverage container as an upper part of intermediate member. The system also includes female threads 54. The female threads extend upwardly from the upper surface of the toy vehicle 56. The toy vehicle is formed as a skateboard. The female threads are formed as a lower part of the intermediate member for removably coupling with the male threads. Note FIG. 3.

Figure 4:
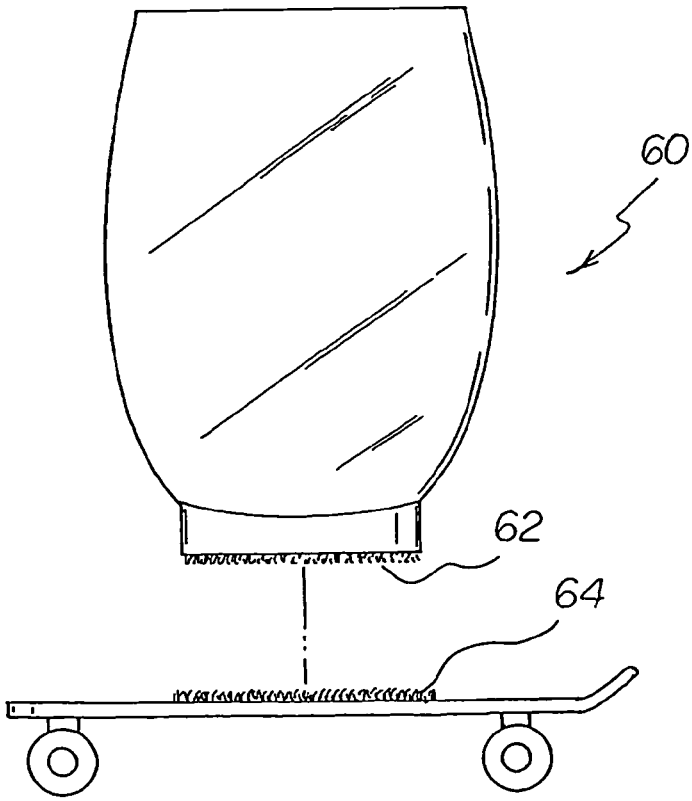
FIG. 4 is a side elevational view of another alternate embodiment of the invention.

In another alternate embodiment of the present invention the system 60 includes upper hook and loop fasteners 62. The upper hook and loop fasteners extend downwardly from the beverage container. The upper hook and loop fasteners are provided as an upper part of intermediate member. The system also includes lower hook and loop fasteners. The lower hook and loop fasteners extend upwardly from the upper surface of the toy vehicle. The toy vehicle is formed as a skateboard. The lower hook and loop fasteners are provided as a lower part of the intermediate member for removably coupling with the upper hook and loop fasteners. Note FIG. 4.

Figure 5:
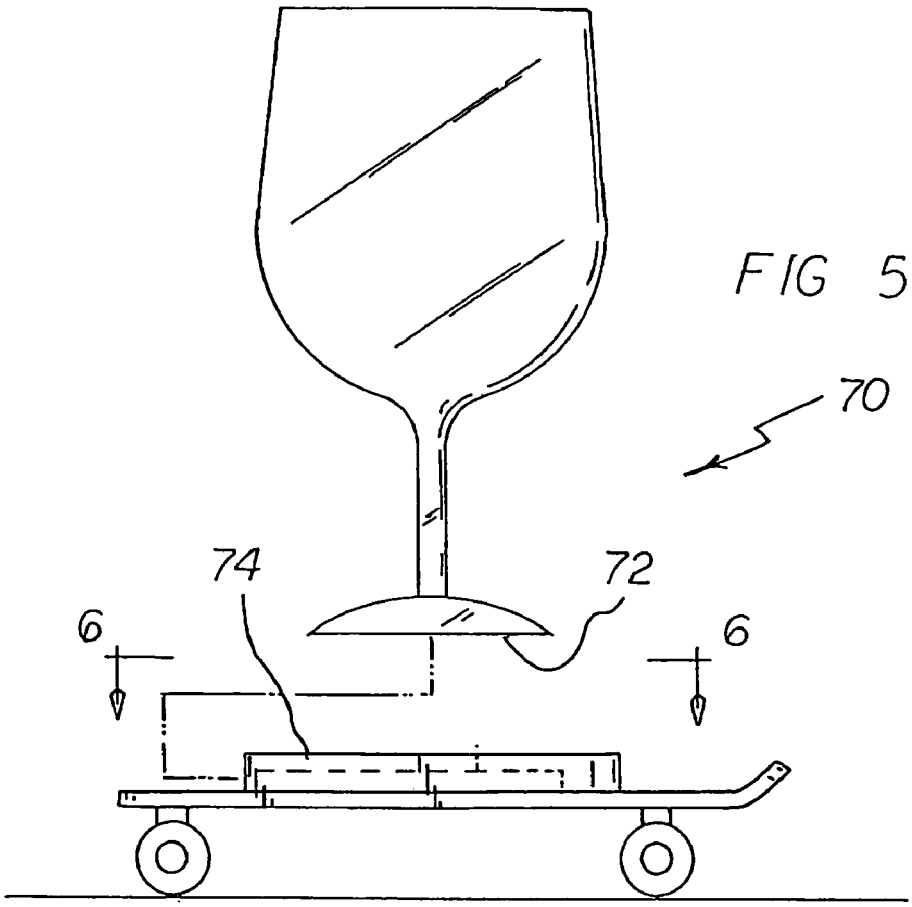
FIG. 5 is an exploded side elevational view of yet another alternate embodiment of the invention.
Figure 6:
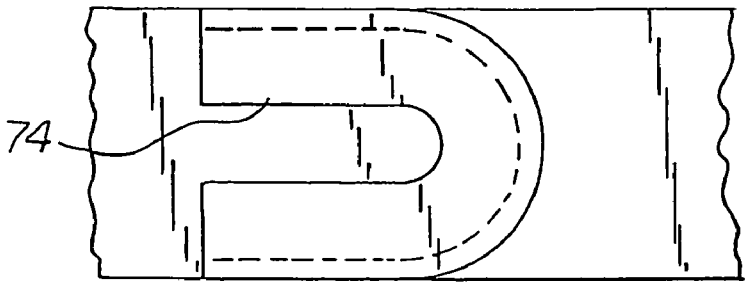
FIG. 6 is a cross sectional view taken along line 6—6 of FIG. 5.

In yet another alternate embodiment of the present invention the system 70 includes a disk-like base 72. The disk-like base is provided at the lower end of a goblet. The disk-like base extend downwardly from the beverage container. The disk-like base is provided as an upper part of intermediate member. A lower U-shaped receptacle 74 is provided. The lower U-shaped receptacle extends upwardly from the upper surface of the toy vehicle. The toy vehicle is formed as a skateboard. The lower U-shaped receptacle is provided as a lower part of the intermediate member for removably coupling with the disk-like base. Note FIGS. 5 and 6.

Figure 7:
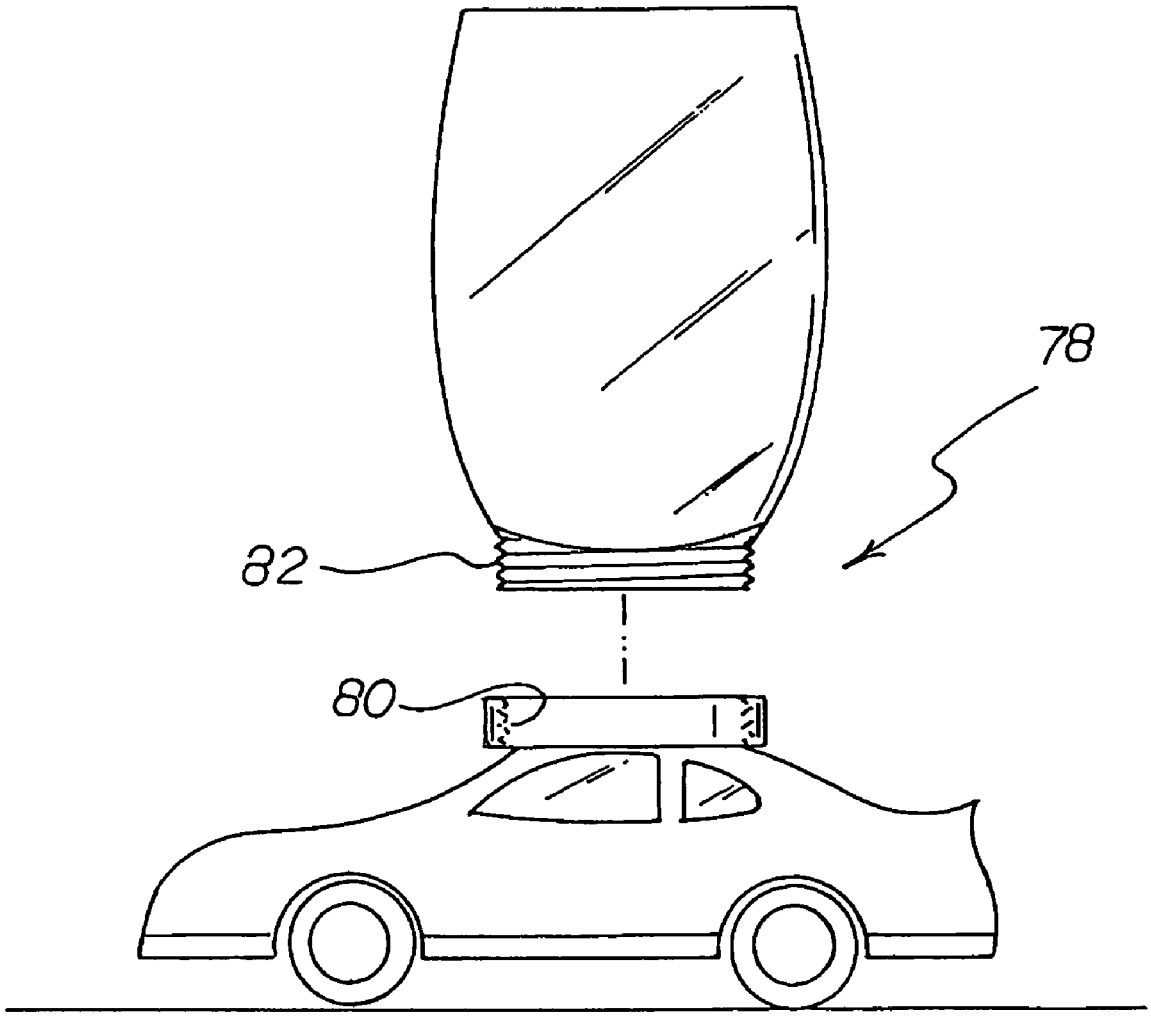
FIG. 7 is an exploded side elevational view of a final alternate embodiment of the invention.

FIG. 7 is an exploded side elevational view of a final alternate embodiment of the invention. In such embodiment, the system 78 includes male threads 82 extending downwardly from the beverage container as an upper part of coupling means. Female threads 80 extend upwardly from the upper surface of the platform as a lower part of the coupling means. The male and female threads are for removably coupling with the male threads of the beverage container with the female threads of the platform.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A beverage container/coaster system for retaining a beverage spaced above a recipient surface to preclude staining the recipient surface while allowing for easy rolling movement of the system upon the recipient surface, the system comprising, in combination:

a toy vehicle having a horizontally disposed base frame with four wheels rotatably coupled to the base frame and extending below the base frame, the toy vehicle also having a body extending above the base frame, the body having a generally flat upper surface in an essentially horizontal plane;

an intermediate member having a hollow cylindrical side wall with a diameter and a top and a bottom and a vertical axis there between, the top being formed as an open circular top and the bottom being formed as a closed circular bottom with an upper face coupled to the side wall at its lower extend and a lower face secured to the flat upper surface of the body of the toy vehicle, the intermediate member including thermal insulation in the side wall and in the bottom; and a beverage container including a cylindrical lower region with a diameter less than the diameter of the intermediate member for allowing the beverage container to be inserted into the intermediate member and to be removed therefrom for the consumption of a beverage therein, the cylindrical lower region of the beverage container adapted to be supported by the upper face of the bottom of the intermediate member at a location above the table top to preclude staining the table top or the recipient surface, the beverage container adapted to be removed from the intermediate member for the consumption of a beverage within the container, and the toy vehicle being adapted to be easily moved by rolling around a table top or other recipient surface.

2. A beverage container/coaster system comprising:

a platform with wheels extending there below and a generally flat upper surface;

a two part coupling means including an upper component and a lower component adapted to releasably attach a beverage container to the platform, the lower component being secured to the upper surface of the platform;

a beverage container formed as a goblet with a top and a bottom including a lower region constituting the upper component and configured for allowing the beverage container to be coupled to the lower component and to be removed therefrom for the consumption of a beverage therein; and wherein the upper component includes a disk base at the lower end of the beverage container extending downwardly from the bottom of the beverage container and further including a U-shaped receptacle for removably coupling with the disk base.

* * * * *